US012239193B2

(12) United States Patent
Kim et al.

(10) Patent No.: US 12,239,193 B2
(45) Date of Patent: Mar. 4, 2025

(54) SPECIALIZED TRAY DEVICE FOR EYELASH EXTENSIONS

(71) Applicant: Kiss Nail Products, Inc., Port Washington, NY (US)

(72) Inventors: Jieun Kim, Jieun, NY (US); Yujin Kim, Bayside, NY (US); Taehoon Kim, Huntington Station, NY (US); Kichul Ahn, Jericho, NY (US)

(73) Assignee: Kiss Nail Products, Inc., Port Washington, NY (US)

( * ) Notice: Subject to any disclaimer, the term of this patent is extended or adjusted under 35 U.S.C. 154(b) by 331 days.

(21) Appl. No.: 17/714,951

(22) Filed: Apr. 6, 2022

(65) Prior Publication Data

US 2022/0400825 A1 Dec. 22, 2022

Related U.S. Application Data

(63) Continuation-in-part of application No. 17/007,982, filed on Aug. 31, 2020, now Pat. No. 11,884,448.

(51) Int. Cl.

| | |
|---|---|
| ***A41G 5/00*** | (2006.01) |
| ***A41G 5/02*** | (2006.01) |
| ***A45C 11/00*** | (2006.01) |

(52) U.S. Cl.
CPC ..... *A45C 11/008* (2013.01); *A41G 5/02* (2013.01)

(58) Field of Classification Search
CPC ..... A41G 5/02; A45D 5/005; B65D 1/36
See application file for complete search history.

(56) References Cited

U.S. PATENT DOCUMENTS

| | | | |
|---|---|---|---|
| 3,315,689 | A | 4/1967 | Mehron |
| 3,333,593 | A | 8/1967 | Mcgivern |
| 3,491,775 | A | 1/1970 | Aylott |
| 3,557,653 | A | 1/1971 | Kim |
| 4,018,336 | A | 4/1977 | Aylott |
| 8,424,542 | B1 | 4/2013 | Han |
| 8,701,685 | B2 | 4/2014 | Chipman |
| 10,588,389 | B1 | 3/2020 | Ruiz |
| 2013/0042884 | A1 | 2/2013 | Wilkinson |
| 2014/0116459 | A1 | 5/2014 | Mckinstry |
| 2015/0351476 | A1 | 12/2015 | Lin |
| 2020/0288834 | A1 | 9/2020 | Haywood |
| 2021/0095170 | A1 | 4/2021 | Lotti |

FOREIGN PATENT DOCUMENTS

| | | | |
|---|---|---|---|
| JP | 2011177395 A | * | 9/2011 |
| WO | 2020082058 | | 4/2020 |

* cited by examiner

*Primary Examiner* — Rachel R Steitz
(74) *Attorney, Agent, or Firm* — Cherskov Flaynik & Gurda, LLC

(57) ABSTRACT

An artificial eyelash extension storage system is provided. The artificial eyelash extension storage system comprises a protective element, a securing element including a flange and an insert, and a support assembly including a groove and a lip, wherein the insert fits into the groove in response to the securing element being combined with the support assembly.

14 Claims, 15 Drawing Sheets

SPECIALIZED TRAY DEVICE FOR EYELASH EXTENSIONS

This application claims priority as a continuation in part of U.S. patent application Ser. No. 17/007,982 filed on Aug. 31, 2020, presently pending, the contents of which is incorporated herein by reference in its entirety.

BACKGROUND

1. Field

The field of the invention is an eyelash extension support and storage system.

2. Description of the Related Art

Artificial eyelashes are popular products that are used to improve the look of a user's lash line through the addition of lash length and volume. Such artificial eyelashes typically comprise a lash line strip with lashes extending from there. The lashes can be made from mink, synthetic materials, horsehair, and in some instances, human hair.

Recently, do-it-yourself eyelash extension systems have been developed and become popular. The do-it-yourself systems provide one-piece eyelashes of various lengths that simply need to be moved into place and adhered to a user's eyelashes or eyelids. These do-it-yourself systems must make it to a user with the eyelash extensions intact and suitable for use (without deformation) when they are purchased. Prior-art eyelash extension storage systems have not yet provided an adequate, robust system for supporting and storing eyelash extensions.

A need exists in the art for eyelash extension systems that eliminate the difficulties of prior art systems. A need also exists for a means which facilitates support and storage of eyelash extensions without damage, wherein that system can be reused or even refilled.

SUMMARY

An object of the invention is to create a support and storage system for eyelash extensions that overcome the drawbacks in the prior art. A feature of the invention is that the eyelash extension support and storage system has a support and storage assembly featuring indentations that reversibly receive eyelash extensions, the support assembly, and indentations then overlaid by a securing element. An advantage of the invention is that the eyelash extensions are supported and secured without deformation or damage.

The invention provides an eyelash extension storage system comprising:

a lash support assembly comprising: a substrate defining a plurality of semi-circular depressions; a lip surrounding each of the semi-circular depressions, wherein the lip has a perimeter, and wherein the perimeter features a plurality of sets of indentations spaced around said perimeter; a securing element adapted to nest within the lash support assembly, the securing element comprising: a semi-circular insert having a substantially similar shape and size to the semi-circular depressions of the lash support assembly, wherein the semi-circular insert is surrounded by a flange configured to overlay the lip of the lash support assembly.

BRIEF DESCRIPTION OF THE DRAWINGS

The invention together with the above and other objects and advantages will be best understood from the following detailed description of the preferred embodiment of the invention shown in the accompanying drawings, wherein.

DETAILED DESCRIPTION

Figure 1A:
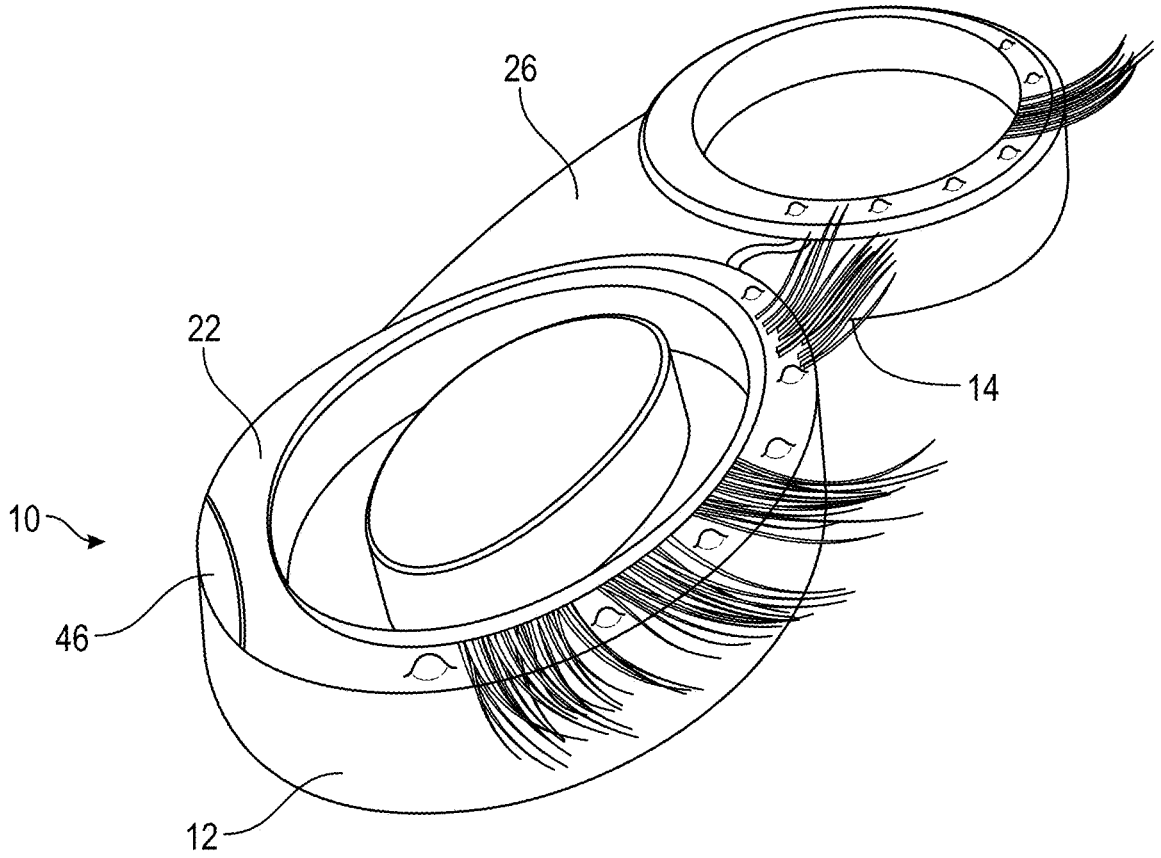
FIG. 1A is a perspective view of an eyelash extension support and storage system in accordance with the features of the present invention.

Hereinafter, preferred embodiments of the present invention will be described in detail with reference to the accompanying drawings. Advantages and features of the present invention and methods of achieving them will become apparent with reference to the embodiments described below in detail in conjunction with the accompanying drawings. However, the present invention is not limited to the embodiments described below, but may be implemented in various different forms, and these embodiments are provided only for making the description of the present invention complete and fully informing those skilled in the art to which the present invention pertains on the scope of the invention, and the present invention is only defined by the scope of the claims. Like reference numerals refer to like elements throughout.

In various embodiments, the invention provides a ready-to-apply eyelash extension system. The eyelash extension system comprises lash filaments extending from an eyelash strip wherein the filaments feature adhesive elements for attachment to the natural eyelashes of a user.

The foregoing summary, as well as the following detailed description of certain embodiments of the present invention, will be better understood when read in conjunction with the appended drawings.

As used herein, an element or step recited in the singular and proceeded with the word "a" or "an" should be understood as not excluding plural said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Turning to the figures, FIG. 1A depicts a perspective view of an exemplary embodiment 10 of the invented lash extension support and storage system. The storage system 10 generally comprises a support assembly 12 and securing element 22 that support and store lash extensions 14. As depicted, the lash extension system 10 is designed to support and store a plurality of lash extensions 14, wherein the lash extension systems have a lash strip 16 that is a fraction of the length of a human's eyelid. This is exemplary and not meant to be limiting. In alternative embodiments, the storage system supports and stores full-size eyelash extensions (not shown).

Figure 2:
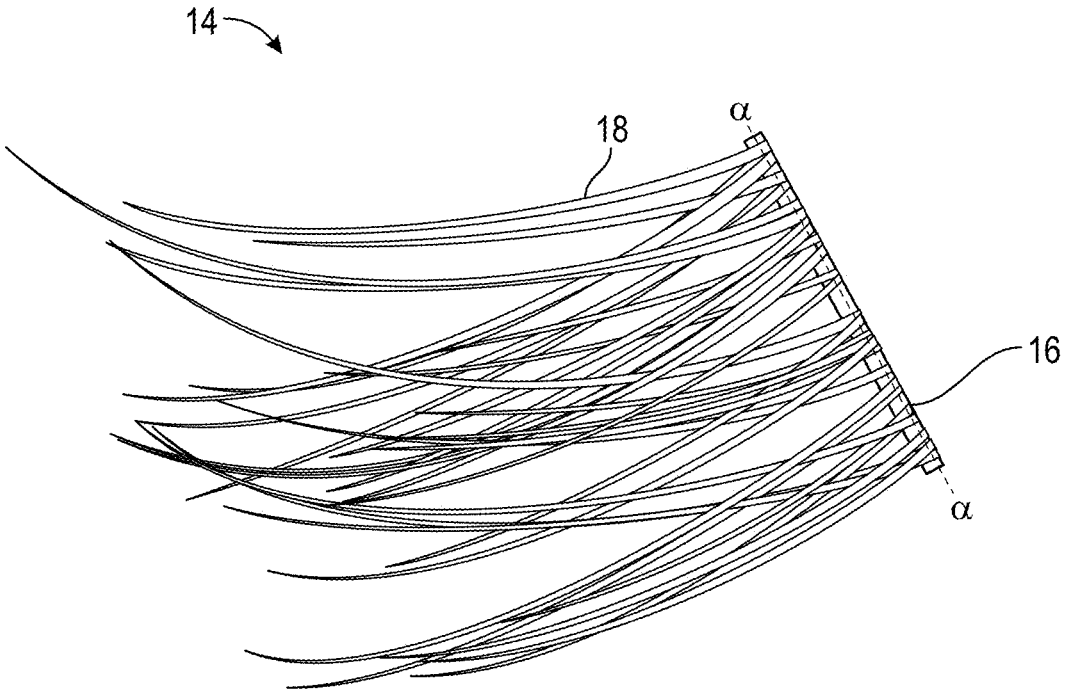
FIG. 2 is a perspective view of a set of eyelash extensions.

FIG. 2 is a detailed view of a lash extension system 14. The lash extension system features eyelash filaments 18 extending from a lash strip 16, wherein the lashes extend in a direction away from the longitudinal axis a of the lash strip 16. The lash strip 16 is curved to approximate the curvature of the leading edge of a user's eyelid.

The lash extension storage system 10 shown in FIG. 1A primarily comprises two components, a support assembly 12 and securing elements 22. FIGS. 1A-E show more detailed views of these components.

Figure 1B:
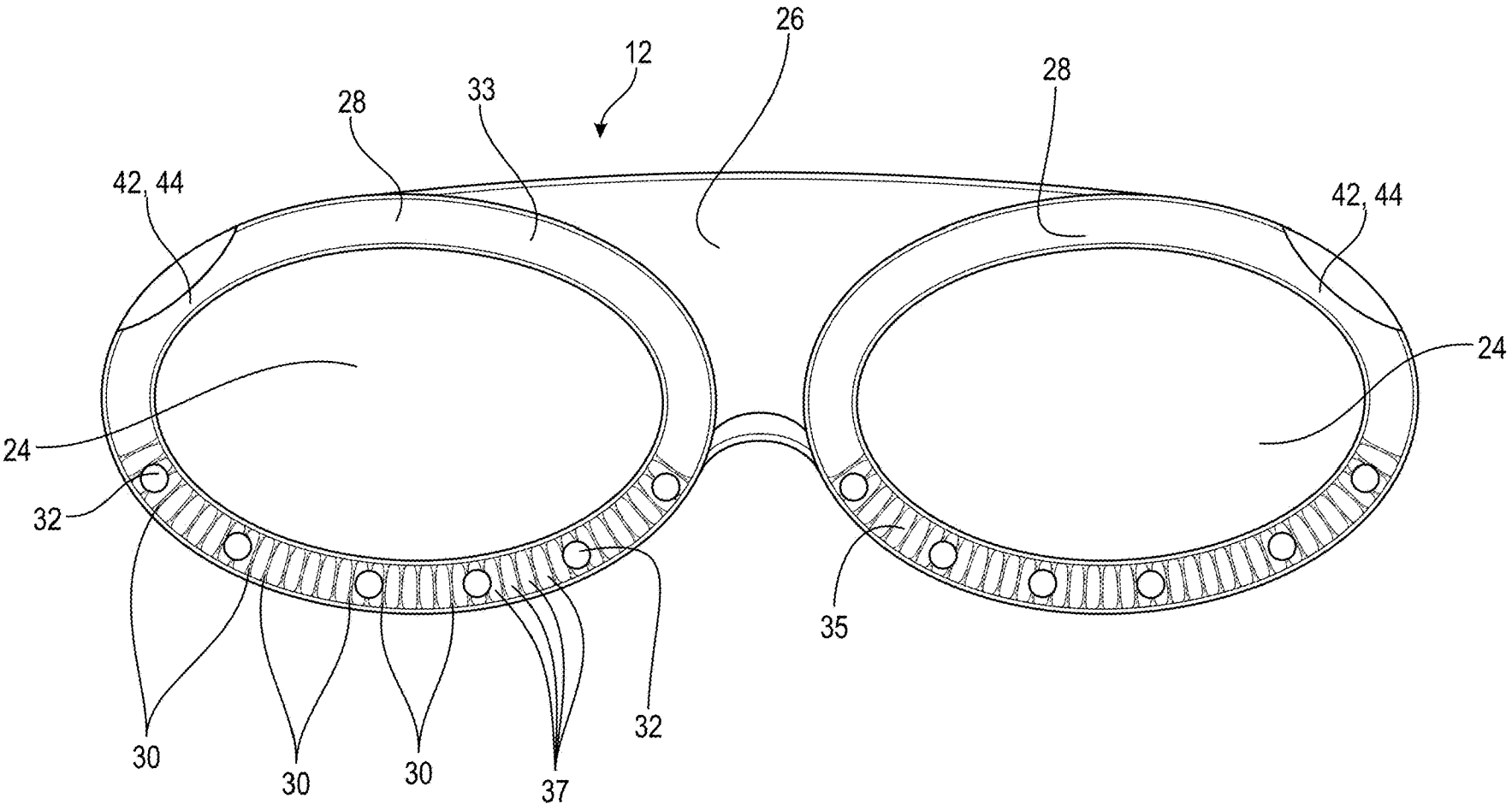
FIG. 1B is a detailed view of a support assembly for an eyelash extension support and storage system in accordance with the features of the present invention.

FIG. 1B is a detailed view of the support assembly 12. The support assembly 12 is a one-piece element formed of a substrate featuring two semi-circular depressions 24 connected by a substantially flat intermediate portion 26. Each semi-circular depression 24 is surrounded by a lip 28 that surrounds the semi-circular depression 24. The lip 28 has a width w and extends a height h from the substantially flat intermediate portion.

Any material suitable for making durable packaging is suitable for use as the substrate forming the components of the instant invention. Exemplary materials include plastic, elastomeric polymers, wood, canvas, card stock, and combinations thereof.

The exemplary embodiments shown in the figures all show the invented storage device featuring connected, round storage portions. This is exemplary and not meant to be limiting. In an embodiment, the invented storage device is an individual storage device designed to hold some fraction of the number of lash extension systems held by a larger system. Users may find smaller embodiments of the invention convenient to carry with them outside of the home or to handle while accessing and using the system.

The lips 28 surrounding the semi-circular depressions 24 feature sets of indentations 30 that are spaced apart along a portion of the lip 28. These indentations 30 are adapted to receive lash extension systems while they are stored by the instant lash support and storage system. As shown in FIG. 1B, the indentations feature a bottom surface 35 featuring linear grooves 37 extending away from the semi-circular depression. These grooves 37 provide a mechanism to avoid damage to stored lash extension systems in the event of a downward force on the lash extensions or an overlaying flange (element 36 in FIG. 1C). Should a lash extension or overlaying flange be the subject of downward force, the grooves provide a space for the lash filaments to bend downwardly into without damage. Between each set of indentations, 30 is a protuberance 32 extending from the upwardly facing surface 33 of the lip 28. The protuberances 32 separate sets of indentations 30, allowing for storage of an individual lash extension system 14 in each set of indentations to avoid entanglement of the lash extensions. Further, the protuberances provide a mate for countersunk depressions disposed on the securing elements, as will be discussed, infra.

FIGS. 1A-E show lash and support and storage systems that have five sets of indentations on the support assembly. This is exemplary and not meant to be limiting. The number of indentations can be increased where a larger number of smaller lash extension systems are being stored. Alternatively, the number of indentations can be decreased if the size of the lash extension system being stored increases.

Figure 1C:
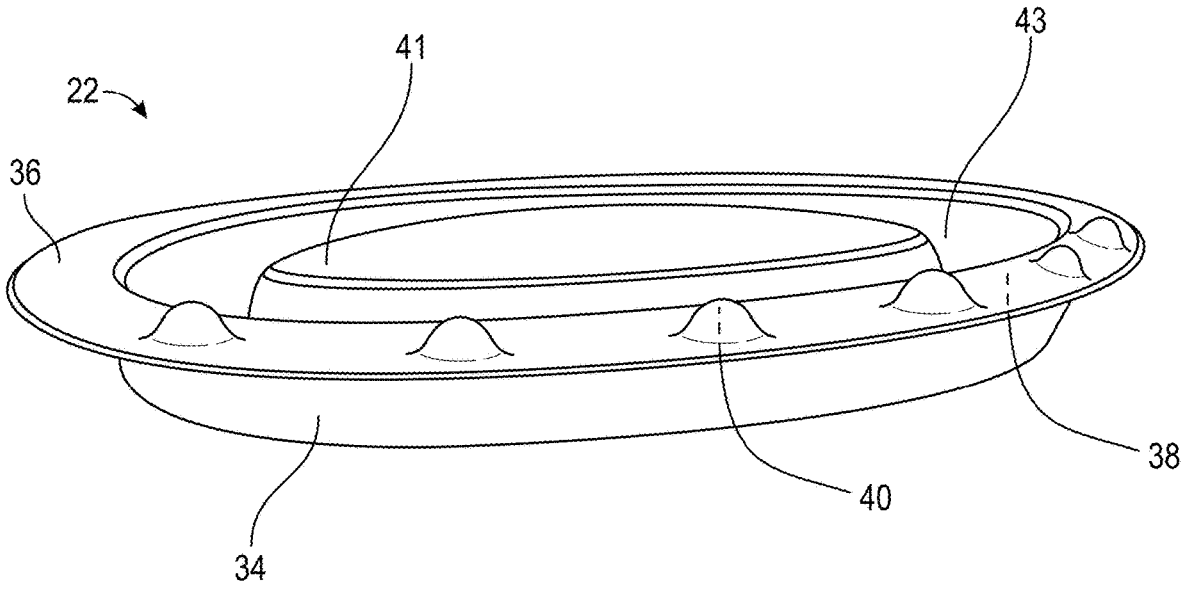
FIG. 1C is a perspective view of a securing element for an eyelash extension support and storage system in accordance with the features of the present invention.
Figure 1D:
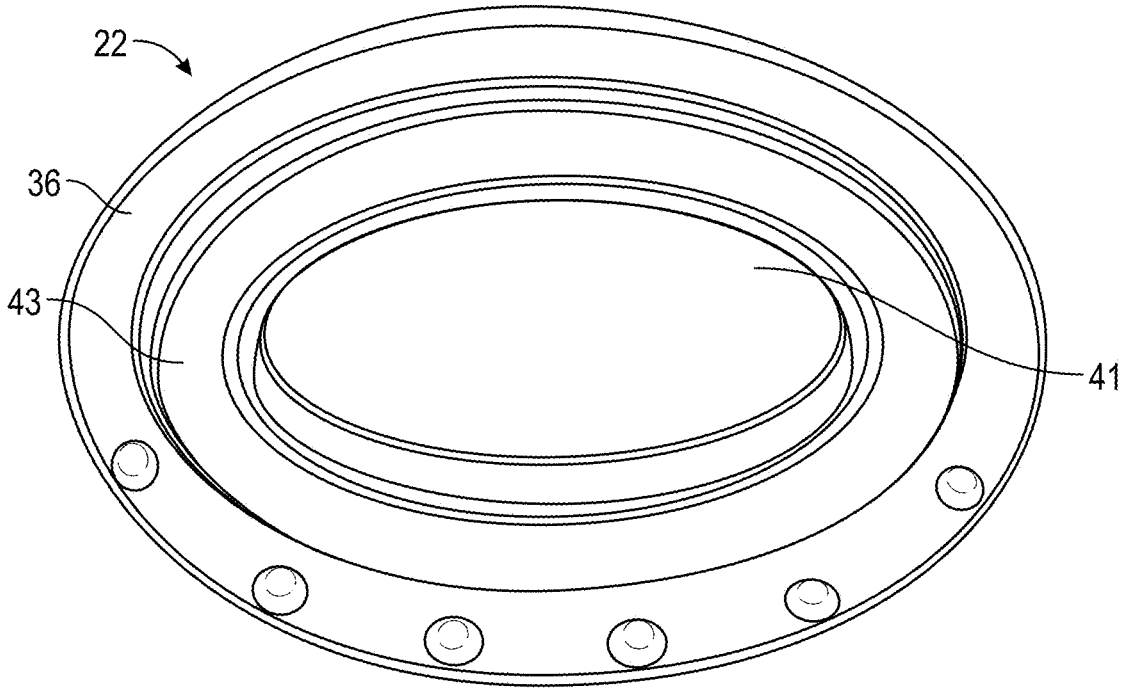
FIG. 1D is a top view of a securing element for an eyelash extension support and storage system in accordance with the features of the present invention.
Figure 1E:
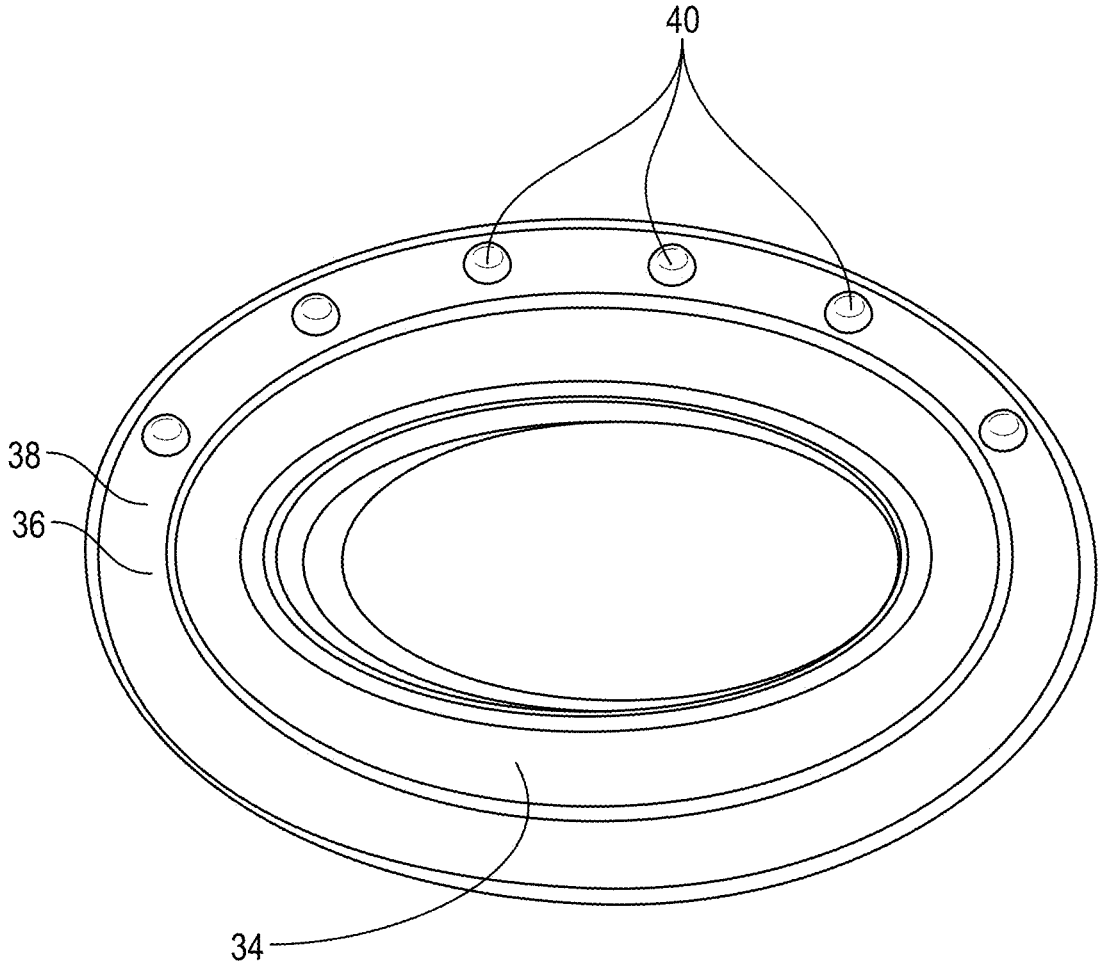
FIG. 1E is a bottom view of a securing element for an eyelash extension support and storage system in accordance with the features of the present invention.

FIG. 1C is a perspective view of a securing element 22. Generally, the securing element comprises a semi-circular insert 34 designed to nest within the semi-circular depression on the support assembly 12. Said semi-circular insert 34 is formed around and generated from an annular depression 43 in a substrate. The annular depression 34 is surrounded by a flange 36. Said flange 36 has a depending surface 38 that features small depressions 40 that are similar in size to the protuberances 32 extending from the support assembly 12. When the securing element 22 is fit into the support assembly 12, the depressions 40 on the flange 36 receive and serve as countersinks to the protuberances on the support assembly.

The securing element 22 shown and described above leverages an annular depression to generate a semi-circular insert to mate with the semi-circular depression on the support assembly. In this embodiment, the annular depression on the securing element surrounds a semi-circular monolith 41 that can be used to show a logo, trademark, ornamentation, or combinations thereof. In alternative embodiments, the securing element 22 features a semi-circular depression that does not feature this semi-circular monolith.

Returning to FIG. 1B, the lip 28 surrounding each semi-circular depression has at least one portion with a reduced width 42. The exemplary embodiment shown in FIG. 1B, includes lateral portions 44 of the lips 28 as the portions with reduced width 42. In this configuration, when the securing element 22 is nested within the support assembly 12, the flanges of the securing elements 22 overlay the lips 28 of the support assembly 12. In the positions where the flange overlays the portion of the lip 28 that has a reduced width, there is a space where no structure is in contact with the portion of the underside of the flange overhanging the support assembly. This portion of the flange overlying the reduced width portion of the lip provides a tab for a user to grasp. In other words, where the flange overlays the portion of a lip having a reduced width, there is a space between the flange and the support assembly. In use, a user can fit their finger or another object between the flange and the support assembly to grasp and pull or push the securing assembly from its position nested within the support assembly.

FIG. 1B shows the portions of the lip having a reduced width positioned on a lateral portion of the semi-circular depressions. This is exemplary and not meant to be limiting.

The portions of the lips having a reduced width can be positioned at any point around the semi-circular depressions.

The shape of the embodiment displayed in FIGS. 1A-E is exemplary and not meant to be limiting. The exemplary embodiment is shaped like two spaced apart human eyes or a pair of glasses. The invented eyelash extension support and storage device can be of any shape.

In use, the lash extensions 14 are inserted into the indentations 30 in the lip of the support assembly with the lash strip 16 adjacent to the semi-circular depression of and the lash filaments 18 extending away from said semi-circular depression. In an embodiment, the lash strip 16 is reversibly secured in position adjacent to the semi-circular depression using adhesive. Alternative embodiments can utilize grooves within the indentations that approximate the size and curvature of the lash strip 16 of the lash extensions 14 to serve as a countersink for the lash strip in place of adhesive.

Once the lash extensions 14 are secured to the support assembly 12, the semi-circular insert 34 of the securing element 22 is removably nested or inserted into the semi-circular depression 24 of the support assembly 12. When the securing element is removably nested within the support assembly, the securing element and support assembly are disposed in substantially similar orientation so that the securing element can readily and snugly mate with the support assembly. As the securing element is inserted into the support assembly, the protuberances 32 on the support assembly are removably received by the depressions 40 on the flange on the securing element. When the securing element and support assembly are mated, the flange on the securing element is in gentle contact with the lash filaments to prevent upward and downward movement of the lash filaments without crushing or reshaping the lash filaments.

To open and retrieve the lash extensions 14, a user locates the portion of the flange (the tab 46) of the securing element overhanging the portion of the lip of the support assembly having a reduced width, grasps that portion of the flange, and pulls the securing element away from the support assembly. A user can then retrieve and apply as many lash extensions 14 to a person's eyelashes as desired. After the lash extensions are used, the lash extensions can be returned to the indentations on the support assembly before the securing element is again mated with the support assembly.

Embodiments shown and described, infra, can be used in substantially the same way. Those embodiments that do not feature portions of the lip of the support assembly of reduced width can still be opened by grasping and pulling the flange of the securing element.

Every embodiment of the invented eyelash extension support and storage system is mechanically robust, wherein the support assembly and related securing element can be mated and separated multiple times without deformation, wearing, or breaking.

Figure 3A:
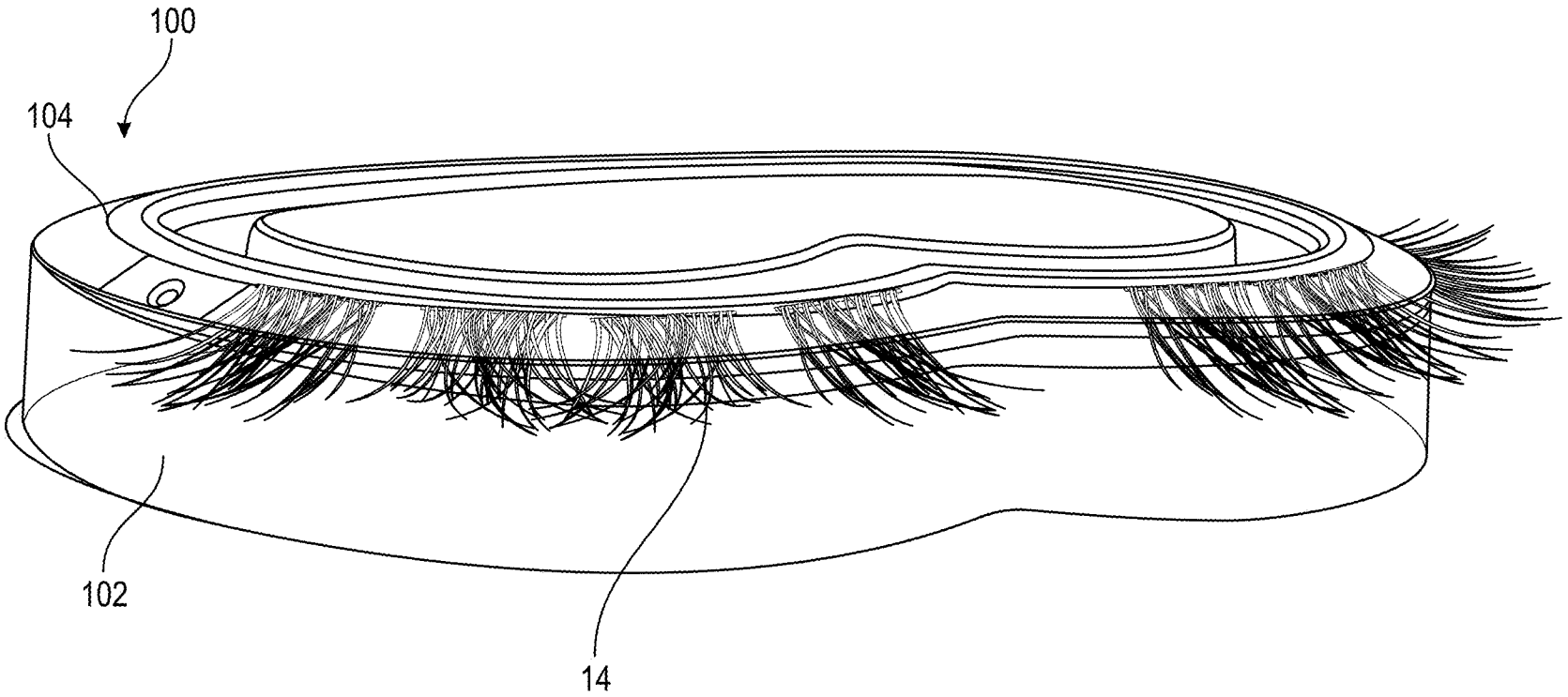
FIG. 3A is a perspective view of an alternative eyelash extension support and storage system in accordance with the features of the present invention.

FIG. 3A is a perspective view of an alternative embodiment 100 of the invented lash extension storage system. This embodiment 100 generally comprises three major elements, a lash support assembly 102, a securing element 104, and lash extension systems 14 that are supported and stored by the embodiment 100.

Figure 3B:
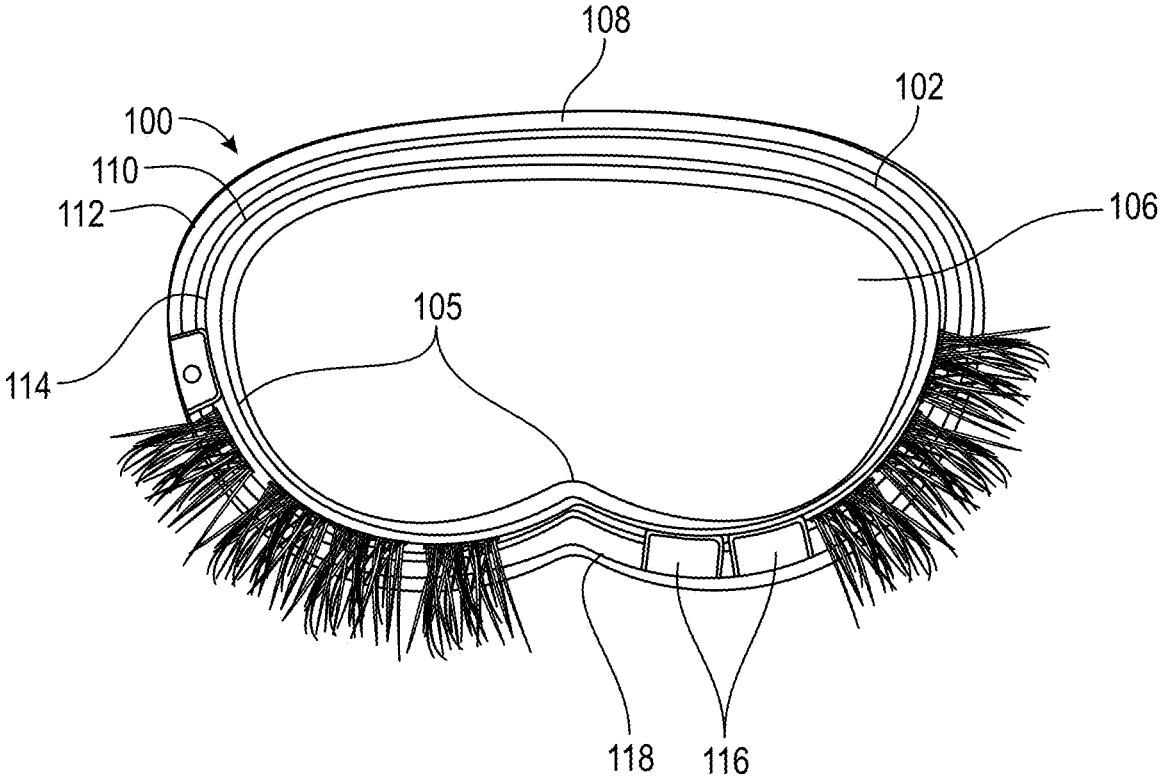
FIG. 3B is a detail view of a support assembly of the eyelash extension support and storage system shown in FIG. 3A in accordance with the features of the present invention.

FIG. 3B is a detailed view of the support assembly 102 shown in FIG. 3A. As described, supra, the invented lash extension storage system can be any shape as demonstrated by the support assembly 102 shown in FIG. 3B. The support assembly 102 in this embodiment is an irregular shape resembling a continuous eye shield such as those on of snow-goggles. In this embodiment, the shape of the support assembly 102 features two portions of higher curvature 105 than the rest of the perimeter of the support assembly 102. These higher curvature 105 portions of the perimeter of the support assembly 102 approximate the curvature of the human eyelid to accommodate the storage of several lash extensions 14.

The support assembly shown in FIG. 3B features a central depression 106 surrounded by a lip 108. The medial portion of the lip 110 (portion immediately surrounding central depression) is substantially flat. A lateral portion of the lip 112 directly adjacent to and surround the medial portion of the lip 110 slopes downwardly. The meeting between the substantially flat, medial 110, and sloped, lateral portion 112 of the lip defines a shoulder 114.

As shown in FIG. 3B, the portions of the lateral lip having higher curvature 105 than the rest of the lip feature a plurality of indentations or indentations 116. These indentations are spaced along the higher curvature portion of the lateral lip and extend between the terminal edge of the lip 118 and the shoulder 114 of the lip. In the configuration shown in FIG. 3B, the indentations are spaced apart with no protrusions disposed between individual indentations. As will be shown and discussed, infra, this design is to accommodate a securing member 104 shown in detail in FIG. 3C that does not have countersunk depressions to receive protrusions from the support assembly. Such an assembly is desirable for easier machining and mold-making. In use, the indentations 116 are configured to reversibly receive a lash extension system 14.

Figure 3C:
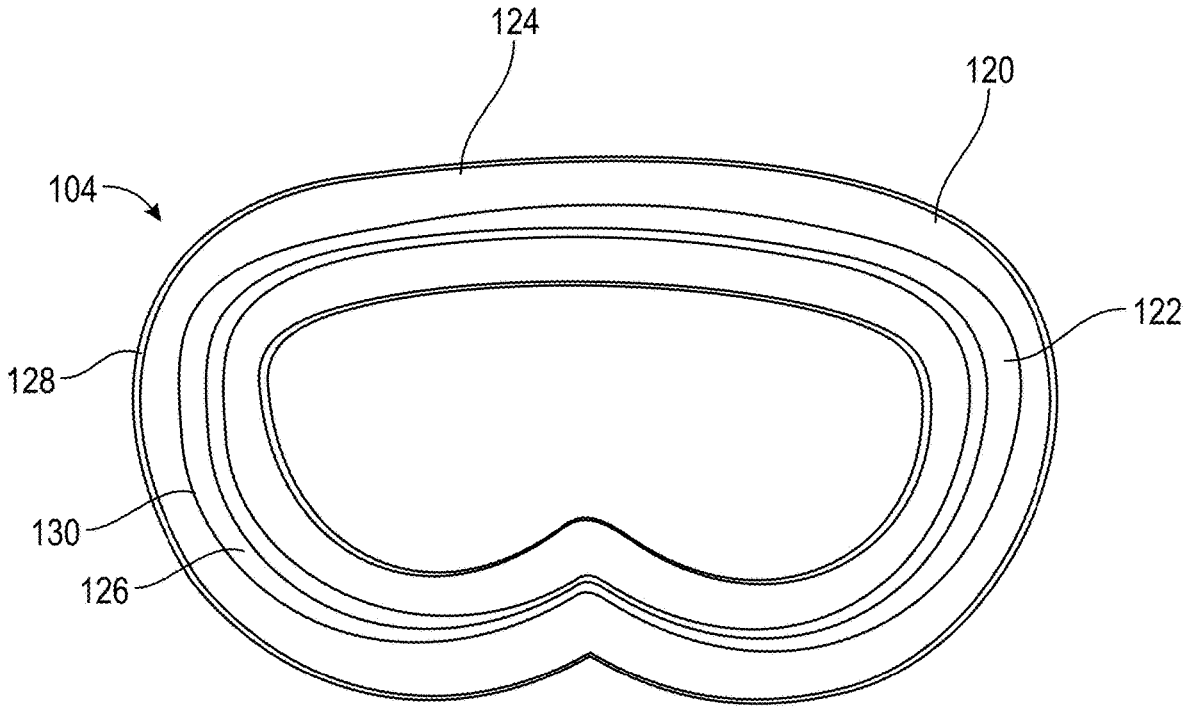
FIG. 3C is a detail view of a securing element of the eyelash extension support and storage system shown in FIG. 3A in accordance with the features of the present invention.

FIG. 3C is a detail view of the securing element 104 of the embodiment 100 shown in FIG. 3A. The securing element comprises a one-piece substrate 120 mirroring the shape of the support assembly shown in FIG. 3A. The securing element features a depression 122 closely mirroring the perimeter of the shape of the depression in the support assembly. The depression on the securing element is slightly smaller than the depression on the support assembly to allow for nesting of the securing element within the depression on the support assembly.

Similar to the embodiment of the securing element shown in FIG. 1C, the securing element 104 featured in the embodiment shown in FIG. 3A-C likewise features a flange 124 that surrounds the perimeter of the depression. The flange 124 is configured to overlay the lip 108 of the support assembly when the securing element is nested within the support assembly. A medial portion of the flange 126 (portion immediately surrounding central depression) is substantially flat. A lateral portion of the flange 128 directly adjacent to and surround the medial portion of the lip 126 slopes downwardly. The meeting between the substantially flat, medial 126 and sloped, lateral portion 128 of the flange defines a shoulder 130.

The embodiment of the invention shown in FIGS. 1A-E and 3A-C feature support assemblies formed as one piece from a single substrate for ease of engineering, machining, and manufacturing. This is exemplary and not meant to be limiting. A person of ordinary skill in the art could readily discern how the elements of the instant invention could be assembled from separate components instead of formed from a single substrate.

FIGS. 3A-C does not show the use of protuberances on the lip of the support assembly or depressions on the flange of the securing element to receive said protuberances. This is exemplary and not meant to be limiting. Alternatively, the embodiment shown in FIGS. 3A-C can feature the aforementioned protuberances and depressions to facilitate mating between the support assembly and the securing element shown in FIGS. 3A-C.

Figure 4:
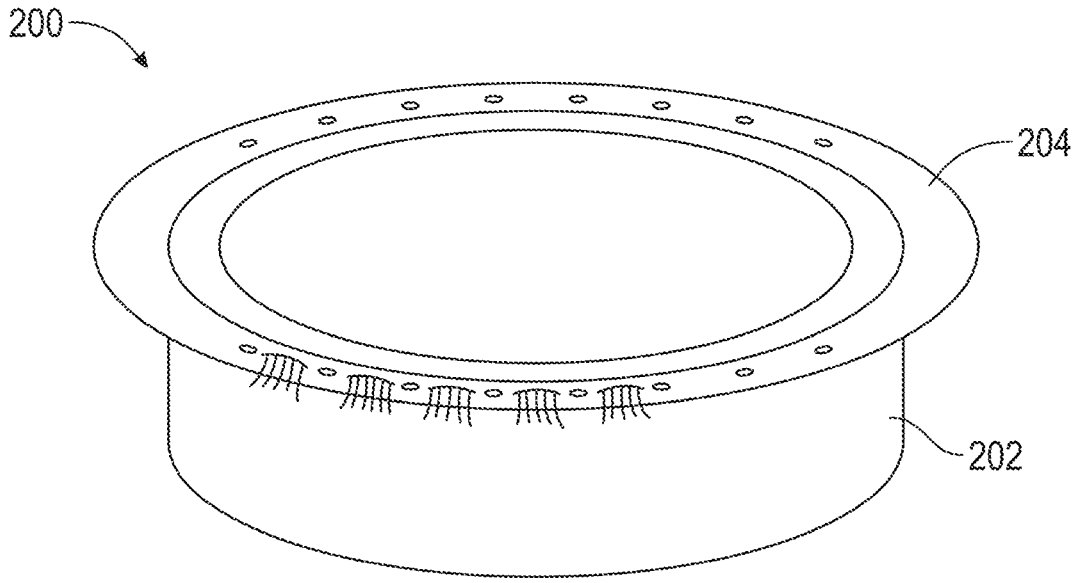
FIG. 4 is a perspective view of an alternative eyelash extension support and storage system in accordance with the features of the present invention.

All embodiments shown and described heretofore feature two curved portions on separate support assemblies that support lash extensions. This is exemplary and not meant to be limiting. An alternative embodiment 200 shown in FIGS. 4A-4B features a single lash support and storage system 200. This embodiment features a lash support assembly 202, much like the support assembly 12 of the embodiment 10 depicted in FIGS. 1A-E where the support assembly 202 comprises a semi-circular depression defined in a substrate, that depression surrounded by a lip having spaced apart indentations separated by protuberances. Similarly, the embodiment 200 features a similar securing element 22 to that of FIGS. 1A-E with more depressions in the underside of its flange. The embodiment 200 shown in FIG. 4 differs from earlier embodiments in that it features more protuberances and indentations disposed on the lip of the support assembly. While the embodiment shown in FIGS. 1A-E features grooves and protuberances spread over half or less than half of the length of the lip, the embodiment 200 shown in FIG. 4 features indentations spread over much more of the length of the lip in order to accommodate support and storage of more lash extension systems.

Figure 5A:
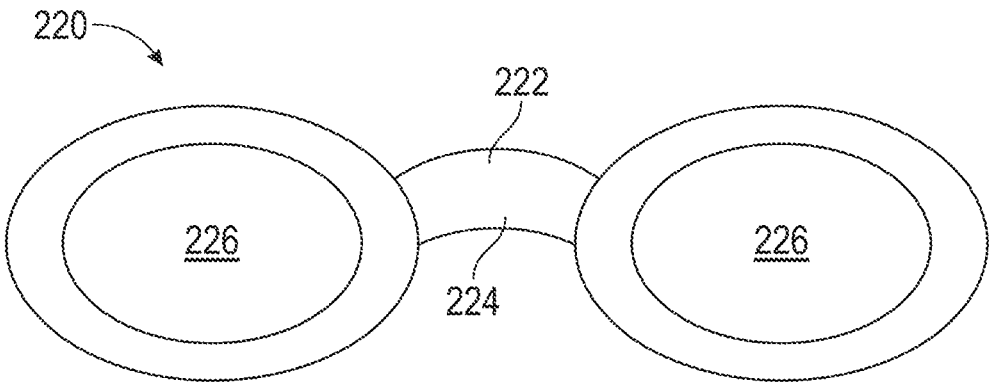
FIGS. 5A-B depict an alternative eyelash extension support and storage system in accordance with the features of the present invention.
Figure 5B:
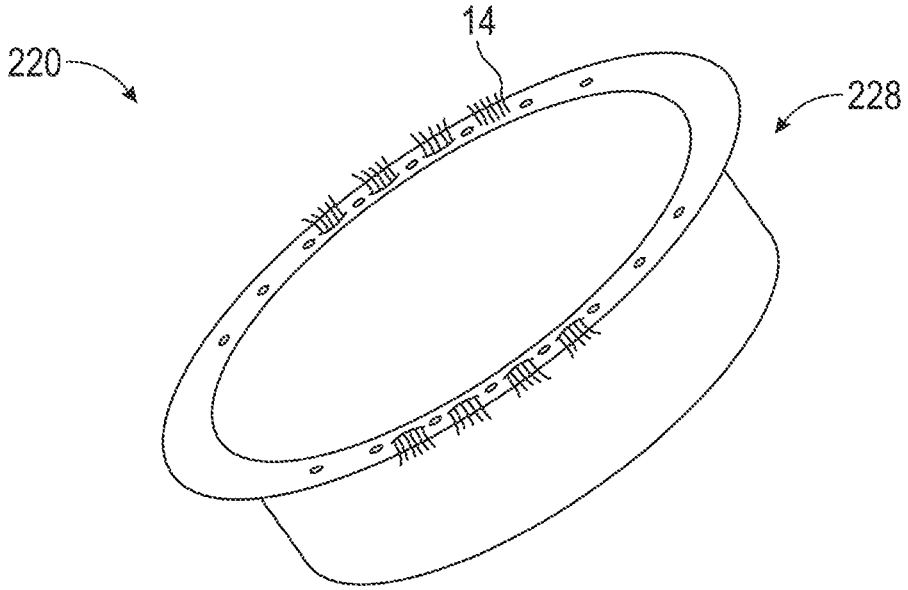

FIGS. 5A-5B show another embodiment 220 of the instant invention providing a refillable lash extension and support system. This embodiment features a refillable scaffolding 222 comprising a substrate 224 defining a plurality of semi-circular voids 226.

FIG. 5B shows a combined storage and support module 228 adapted for reversible insertion into the semi-circular voids 226 of the scaffolding 222. The storage and support modules 228 are standalone lash extension storage systems similar to that of FIG. 4 designed for reversible insertion into the voids 226 of the scaffolding 222. The storage and support modules can be used with or without insertion into the scaffolding 222. In use, the modules 228 can be purchased, inserted into the scaffolding, removed when depleted of available lash extension systems and replaced with new modules full of new lash extension systems.

Figure 6A:
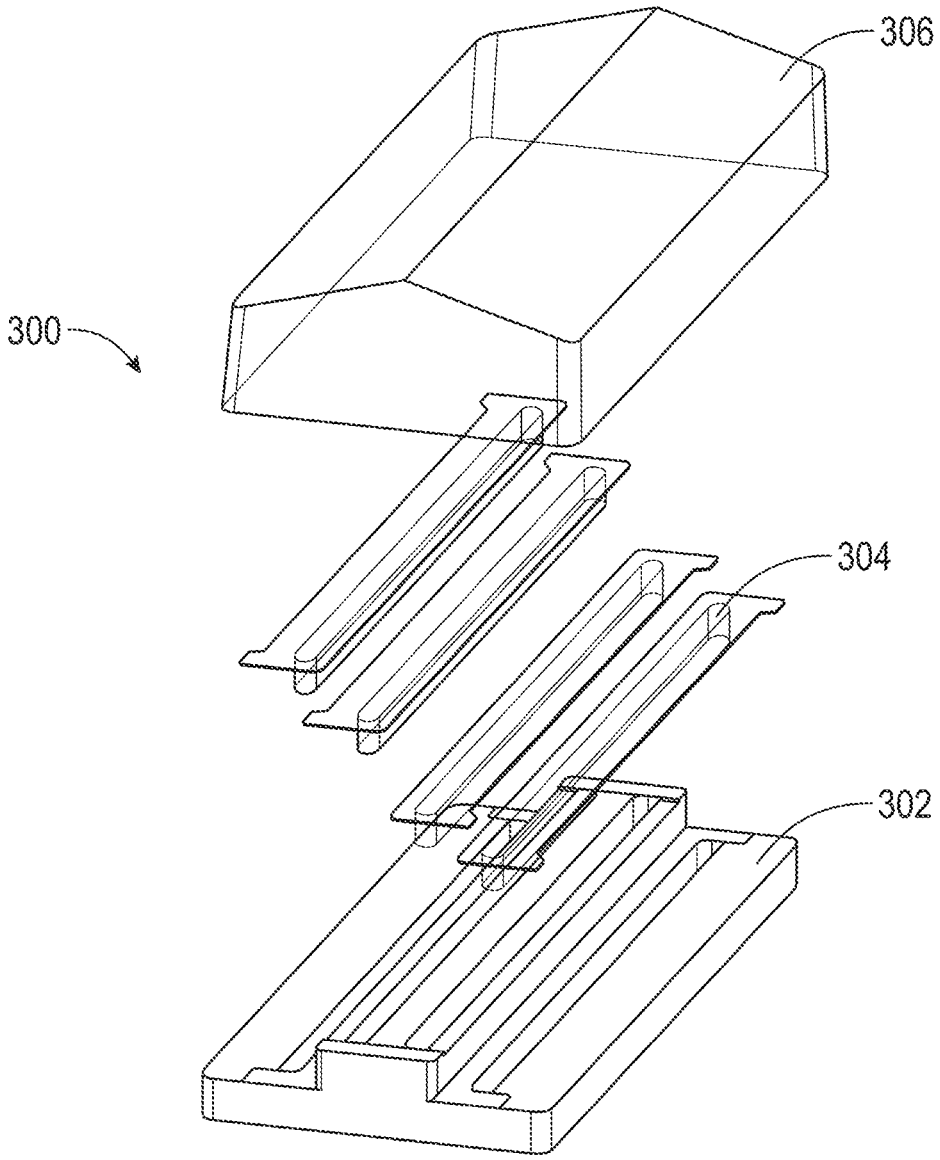
FIG. 6A is a perspective view of an alternative embodiment of the invented artificial eyelash extension storage system.

FIG. 6A is a perspective view of an alternative embodiment 300 of the invented artificial eyelash extension storage system. This embodiment 300 generally comprises three major elements: a support assembly 302, a securing element 304, and a protective element 306. The protective element 306 is designed to cover the support assembly 302 and the securing element 304. Further, the protective element 306 may be made of a fully or partially transparent material so that the inside thereof can be seen in a state that the protective element 306 covers the support assembly 302 and the securing element 304. Other elements of the invented artificial eyelash extension storage system 300 including the support assembly 302 and the securing element 304 will be described in detail below with reference to FIGS. 6C-6D.

Figure 6B:
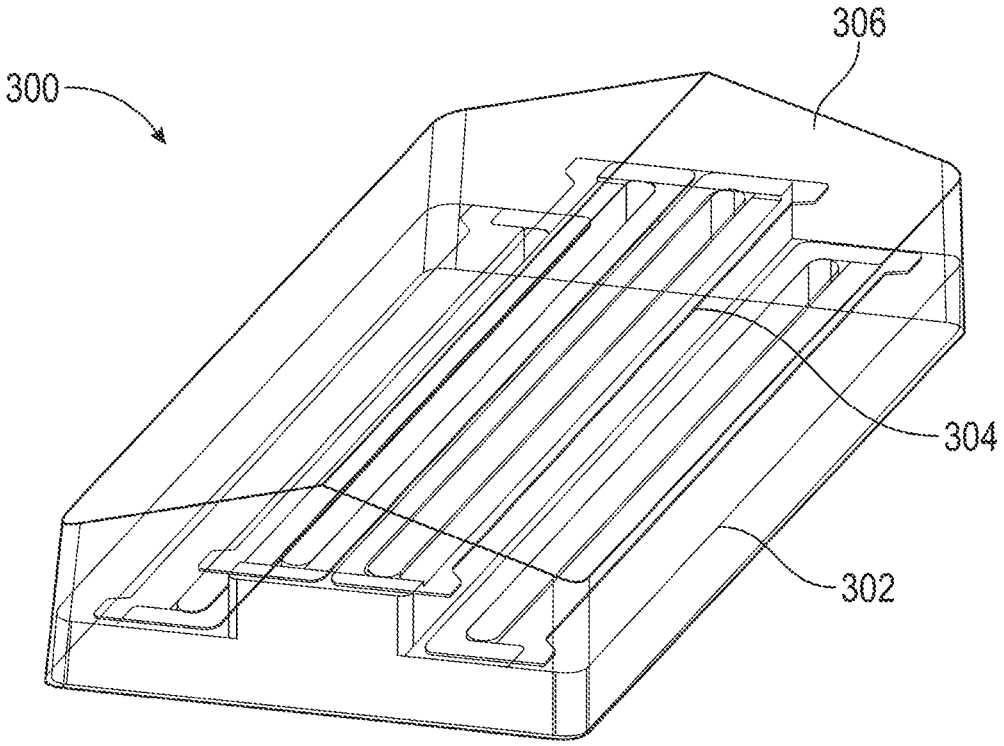
FIG. 6B is a perspective view of the invented artificial eyelash extension storage system of FIG. 6A in a state that each element is combined with each other.

FIG. 6B is a perspective view of the invented artificial eyelash extension storage system 300 of FIG. 6A in a state that each element is combined or fittingly engaged with each other. In one embodiment, the securing element 304 may fit into a groove formed in the support assembly 302, and the protective element 306 may fully or partially enclose the support assembly 302 to cover the top surface of the support assembly 302 and the securing element 304, as shown in FIG. 6B.

Figure 6C:
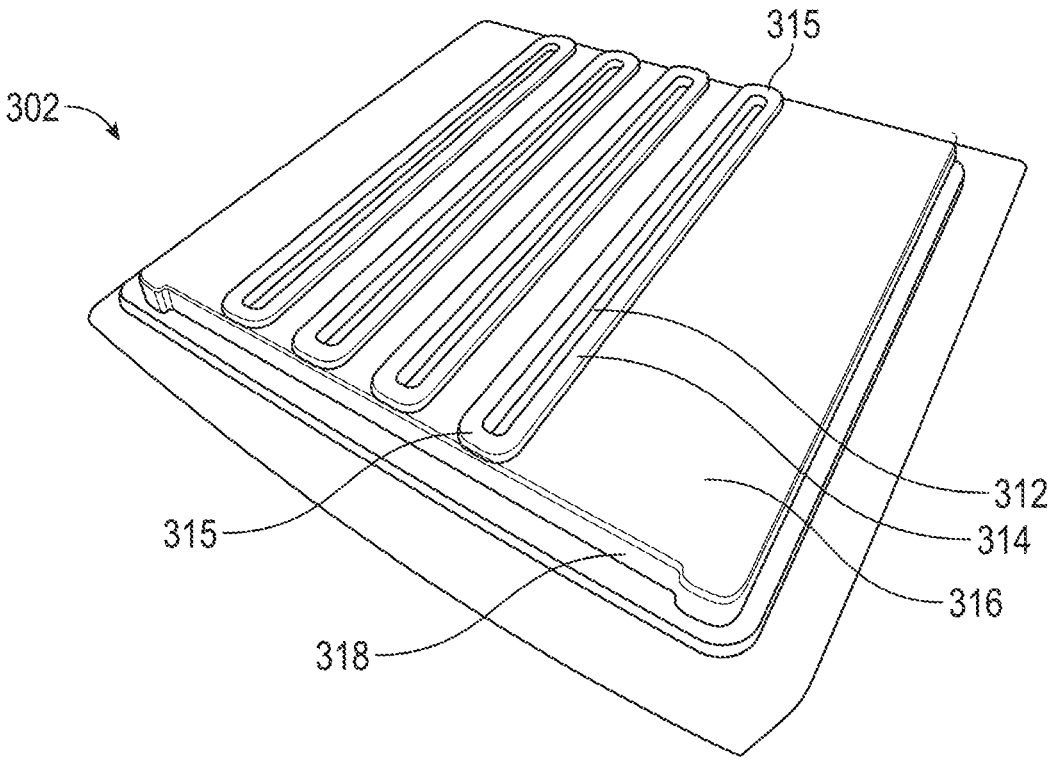
FIG. 6C is a detailed view of the support assembly shown in FIG. 6A.

FIG. 6C is a detailed view of the support assembly 302 shown in FIG. 6A. The support assembly 302 in this embodiment has an overall rectangular shape. The support assembly 302 may have one or more grooves 312 formed therein. The securing element 304 fits into the groove 312. As illustrated in FIG. 6C, a plurality of grooves 312 may be formed to accommodate a plurality of securing elements 304. In one embodiment, the plurality of the grooves 312 may be arranged side by side, parallel to the longitudinal direction or the width direction of the support assembly 302. Otherwise, in another embodiment, the plurality of grooves 312 may be disposed obliquely or diagonally in the longitudinal direction or the width direction of the support assembly 302. Although it is illustrated that the groove 312 has a shape of an elongated rectangle with rounded corners, the present embodiment is not limited thereto, and the shape of the groove 312 may be variously determined to be suitable for accommodating the securing element 304.

A lip 314 protruding upward from the surface of the support assembly 302 may be formed around each of all or some of the groove 312. In one embodiment, the lip 314 may have a raised step 315 at one end or both ends such that when the securing element 304 fits into the groove 312, there is a gap (having a height equal to the height of the raised step 315) between the securing element 304 and the lip 314 that allows users to easily remove the artificial eyelash extension systems 326 that are placed in that space on the flange 324 without deforming them. Further, the shape of the lip 314 may be variously determined to be suitable for surrounding the groove 312. For example, the shape of the lip 314 may be different from the contour of the groove 312 while still surrounding the groove 312 (e.g., a semi-circular lip surrounding a rectangular groove). Although it is illustrated in FIG. 6C that all lips 314 have the same height, the present embodiment is not limited thereto, and some lips 314 may have different heights than other lips 314, as shown in FIG. 6A. Likewise, although it is illustrated that the lips 314 have rounded corners, the present embodiment is not limited thereto, and the shape of the lips 314 may be variously determined.

The support assembly 302 may have an auxiliary space 316 for accommodating an applicator for artificial eyelash extension systems that is used to pick up an artificial eyelash extension system from the artificial eyelash extension storage system 300. In one embodiment, the auxiliary space 316 may include a depression into which the eyelash extension applicator can be placed and stored. In this case, the shape of the depression may be variously determined according to the shape of the artificial eyelash extension system applicator.

The support assembly 302 may have an outer wall 318 defining the overall shape and dimensions of the support assembly 302. As described above with reference to FIG. 6B, the protective element 306 may cover the support assembly 302 by enclosing the outer wall 318. Although it is illustrated in FIG. 6C that the outer wall 318 is formed in a stepwise manner, including two steps, the present embodiment is not limited thereto, and the outer wall 318 may be formed in more steps or without any step, including a curved wall.

In one embodiment, additional depressions (not shown) may be formed to surround the lip 314 in the support assembly 302 to provide a free space. That way, when a user picks up artificial eyelash extension systems using an applicator, it becomes easier to maneuver the applicator without hitting the support assembly 302.

Figure 6D:
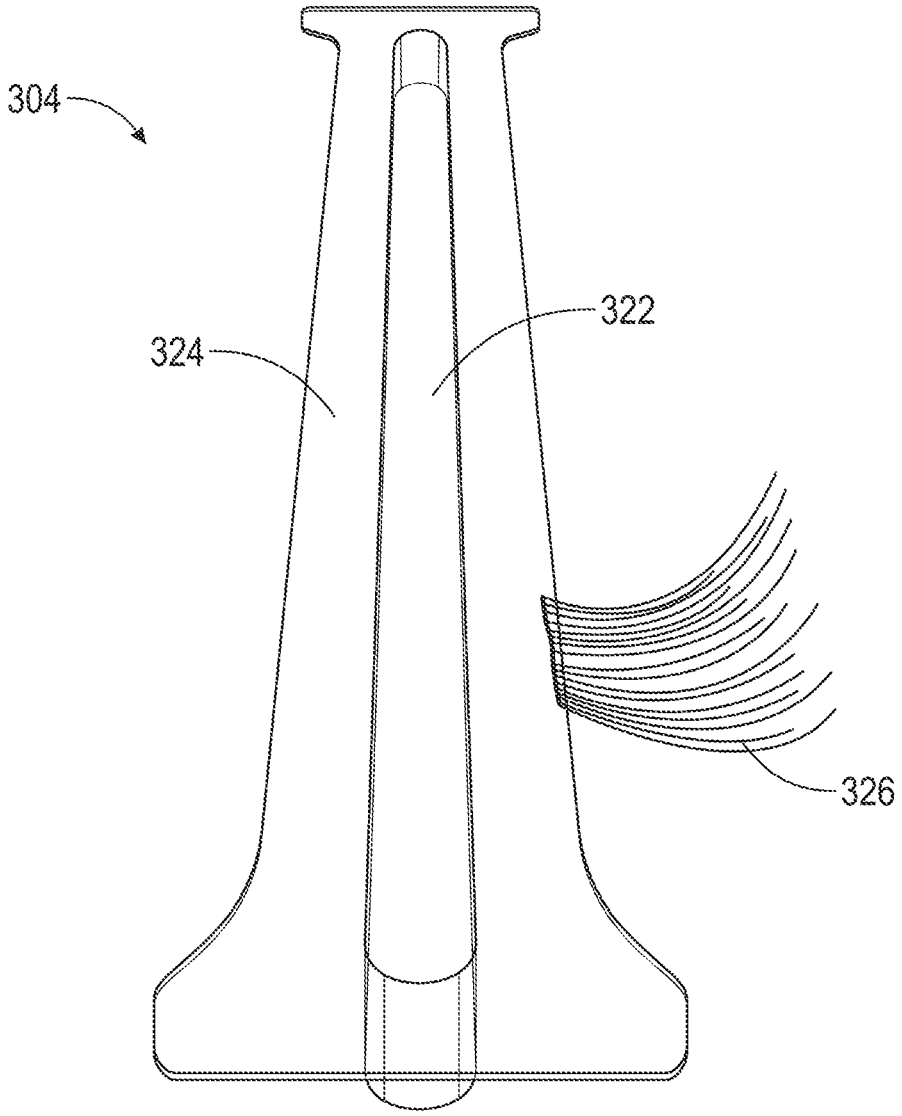
FIG. 6D is a perspective view of the securing element of the invented artificial eyelash extension storage system 300 in FIG. 3A.

FIG. 6D is a perspective view of the securing element 304 of the invented artificial eyelash extension storage system 300 in FIG. 6A. The securing element 304 may comprise an insert 322 and a flange 324. The shape of the securing element 304 may be variously determined. The insert 322 has a shape that is designed to fit into the groove 312 of the support assembly 302 when the securing element 304 is fittingly engaged with the support assembly 302, as shown in FIG. 6B. The insert 322 is surrounded by the flange 324 and protrudes downward from the flange 324.

The flange 324 may hold down artificial eyelash extension systems 326 against the surface of the support assembly 302 or the lips 314 during storage. The flange 324 may also act as the surface on which artificial eyelash extension systems are attached to be stored in the invented artificial eyelash extension storage system 300, in which case the raised step 315 is helpful in creating the aforementioned gap between the flange 324 and the lip 314 that allows users to easily remove the artificial eyelash extension systems 326 that are adhered to the flange 324 without deforming them. As shown in FIG. 6D, the support strip and/or the eyelash filaments of the artificial eyelash extension system 326 may be attached to the lower surface of the flange 324 to prevent foreign substances or dusts from sticking to an adhesive, a glue, a sticker, etc. that is applied to or pre-applied to the artificial eyelash extension system 326. A plurality of artificial eyelash extension systems 326 may be attached to the flange 324 along the longitudinal direction of the flange 324.

Alternatively, the artificial eyelash extension systems 326 may be attached to the upper surface of the lip 314, which is covered by the flange 324 of the securing element 304. The shape of the flange 324 may be variously determined, and it can have shapes that are different from the lips 314 or the groove 312 (e.g., a semi-circular flange and a rectangular lip or groove). In one embodiment, the width of the flange 324 may be so that the flange extends beyond the lip 314 or the groove 312, or vice versa.

When the securing element 304 is fittingly engaged with the support assembly 302, as shown in FIG. 6B, the flange 324 may contact the lip 314 or the surface of the support assembly 302, or there may be a gap between them. Although it is illustrated in FIG. 6D that the flange 324 has a shape, in which the width of the middle portion is narrower than both ends, the present embodiment is not limited thereto, and the shape of the flange 324 may be variously determined.

Although exemplary implementations of the invention have been depicted and described in detail herein, it will be apparent to those skilled in the relevant art that various modifications, additions, substitutions, and the like can be made without departing from the spirit of the invention. These are therefore considered to be within the scope of the invention as defined in the following claims.

It is to be understood that the above description is intended to be illustrative and not restrictive. For example, the above-described embodiments (and aspects thereof) may be used in combination with each other. Also, many modifications may be made to adapt a particular situation or material to the teachings of the invention without departing from its scope. While the dimensions and types of materials described herein are intended to define the parameters of the invention, they are by no means limiting but are instead exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the terms "comprising" and "wherein." Moreover, in the following claims, the terms "first," "second," and "third," are used merely as labels, and are not intended to impose numerical requirements on their objects. Further, the limitations of the following claims are not written in means-plus-function format and are not intended to be interpreted based on 35 U.S.C. § 112, sixth paragraph, unless and until such claim limitations expressly use the phrase "means for" followed by a statement of function void of further structure.

What is claimed is:

1. An artificial eyelash extension storage system comprising:

a securing element including a flange and an insert; and a support assembly including a groove and a lip, wherein the insert fits into the groove in response to the securing element being fittingly engaged with the support assembly, wherein when the securing element is fittingly engaged with the support assembly, there is a gap between the flange and the lip, and wherein the lip is provided with a raised step, and said raised step results in the gap between the flange and the lip when the securing element is fittingly engaged with the support assembly.

2. The artificial eyelash extension storage system of claim 1, wherein when the securing element is fittingly engaged with the support assembly, the flange contacts the lip.

3. The artificial eyelash extension storage system of claim 1, wherein the raised step is provided at an end of the lip in a longitudinal direction.

4. The artificial eyelash extension storage system of claim 1, wherein the raised step is provided on a periphery of the lip.

5. The artificial eyelash extension storage system of claim 1, wherein the flange extends beyond the lip when the securing element is fittingly engaged with the support assembly.

6. The artificial eyelash extension storage system of claim 1, wherein the flange is wider on both ends in a longitudinal direction.

7. The artificial eyelash extension storage system of claim 1, wherein the flange is configured to hold down at least one artificial eyelash extension system against a surface of the support assembly or the lips.

8. The artificial eyelash extension storage system of claim 7, wherein a lower surface of the flange is configured for the artificial eyelash extension system to be attached to.

9. The artificial eyelash extension storage system of claim 7, wherein an upper surface of the lip is configured for the artificial eyelash extension system to be attached to.

10. The artificial eyelash extension storage system of claim 9, wherein the flange is configured to hold down a plurality of artificial eyelash extension systems against the support assembly along a longitudinal direction of the groove.

11. The artificial eyelash extension storage system of claim 1, wherein the groove has a shape of an elongated rectangle.

12. The artificial eyelash extension storage system of claim 1, further comprising a protective element that is configured to fully or partially enclose the support assembly.

13. The artificial eyelash extension storage system of claim 1, further comprising additional lips.

14. The artificial eyelash extension storage system of claim 13, wherein said additional lips comprise raised steps on periphery of each lip.

* * * * *